US007571505B2

(12) United States Patent
Hiller

(10) Patent No.: US 7,571,505 B2
(45) Date of Patent: Aug. 11, 2009

(54) EMBELLISHMENT SETTING APPARATUS

(75) Inventor: Andrew J. Hiller, Farmington, UT (US)

(73) Assignee: We R, Inc., Salt Lake City, UT (US)

( * ) Notice: Subject to any disclaimer, the term of this patent is extended or adjusted under 35 U.S.C. 154(b) by 0 days.

(21) Appl. No.: 11/624,446

(22) Filed: Jan. 18, 2007

(65) Prior Publication Data

US 2008/0173144 A1 Jul. 24, 2008

(51) Int. Cl.
*B25F 1/00* (2006.01)

(52) U.S. Cl. ..... 7/164; 229/143; 229/144; 81/418; 81/421; 81/424.5; 227/143; 227/144

(58) Field of Classification Search ..... 7/164; 229/143, 144; 81/418, 421, 424.5; 227/143, 227/144

See application file for complete search history.

(56) References Cited

U.S. PATENT DOCUMENTS 1,139,938 A * 5/1915 Weinstein ..... 227/144
3,923,229 A * 12/1975 Kruger ..... 227/144
3,984,041 A * 10/1976 LePage et al. ..... 227/76

* cited by examiner

*Primary Examiner*—Joseph J Hail, III
*Assistant Examiner*—Shantese McDonald
(74) *Attorney, Agent, or Firm*—Holland & Hart

(57) ABSTRACT

An embellishment setting device capable of setting a variety of types and sizes of embellishments. The embellishment setting device may include a first lever, a second lever and at least one adjustable segment with a plurality of impact surfaces. The embellishment setting device may also include first and second adjustable segments, where both adjustable segments have a plurality of impact surfaces and wherein the compression of the proximal ends of the first and second levers causes one of the plurality of impact surfaces of the first adjustable segment to bear against one of the plurality of impact surfaces of the second adjustable segment. The embellishment setting device may also include one or more depth gauges and associated extendable hole punches.

25 Claims, 6 Drawing Sheets

EMBELLISHMENT SETTING APPARATUS

FIELD OF THE INVENTION

The instant disclosure relates generally to the field of embellishment setting devices.

BACKGROUND

Home crafts, including without limitation scrapbooking, reupholstering, dog leashes and other desired end uses have become quite popular among certain groups. Many people enjoy enhancing their home crafts with embellishments in order to beautify and improve their visual appeal. One aspect of home crafts that is especially popular is the use of embellishments, such as, for example, eyelets and snaps. To apply embellishments, a person will first typically create a hole in the home craft. An embellishment is then installed or secured to the hole. The materials typically used as home crafts commonly include paper, fabric, leather, plastic, chipboard, wood, acrylic, or any other material through which one can cut a hole and on which an embellishment may be secured to enhance the visual appearance. The tools currently used to cut such holes include various hand-held hole-punchers, as well as nail and hammer-like manual tools. These tools are often noisy, not very robust or durable, difficult to use, and not effective at cutting through thick materials.

Furthermore, after a hole is formed in the home craft, a different tool is generally used to insert and set the embellishment. The embellishment setters and hole punchers also have loose parts which may become lost. Since embellishments come in a variety of shapes and sizes, a person must either rely on one-size-fits-all tools, which are often ineffective, or must possess multiple tools to set the different sized embellishments. The embellishment setters also can be noisy, as many require pounding or pressing in order to set the embellishment.

Thus, there is a need for a multi-purpose tool that performs multiple functions, including measuring, punching holes, and setting a variety of types and sizes of embellishments.

SUMMARY

In at least one embodiment, an embellishment setting device may comprise an apparatus capable of setting a variety of sized embellishments. The embellishment setting device may comprise a first lever, a second lever and an adjustable segment. In many embodiments, each lever has a proximal end and a distal end. In certain embodiments, the second lever is pivotally coupled to the first lever. In at least one embodiment, the adjustable segment is coupled to the distal end of the first lever and has a plurality of impact surfaces positioned opposite the distal end of the second lever such that compression of the proximal ends of the first and second levers causes the one of the plurality of impact surfaces to bear against the distal end of the second lever.

In at least one embodiment, the embellishment setting device may further comprise a second adjustable segment coupled to the distal end of the second lever, where the second adjustable segment has a plurality of impact surfaces and the compression of the proximal ends of the first and second levers causes one of the plurality of impact surfaces of the adjustable segment to bear against one of the plurality of impact surfaces of the second segment.

In at least one embodiment, the embellishment setting device may further comprise a first depth gauge that is connected to the first lever and a second depth gauge that is coupled to the second lever.

In certain embodiments, the embellishment setting device may further comprise a first extendable hole punch connected to the first lever and a second extendable hole punch connected to the second lever.

In at least one embodiment, the distal end of the first lever may further comprise a first structural support that has a distal portion and a proximal portion. The distal end of the second lever may also further comprise a second structural support with a distal portion and a proximal portion. In some embodiments, a first adjustable depth gauge that has a first extendable hole punch receiving portion is connected to the proximal portion of the first structural support. In at least one embodiment, a second adjustable depth gauge that has a second extendable hole punch receiving portion is connected to the proximal portion of the second structural support. A first extendable hole punch may also be connected to the first structural support. In certain embodiments, when the first extendable hole punch is extended, it contacts the first extendable hole punch receiving portion of the first structural support. A second extendable hole punch may also be connected to the second structural support. In certain embodiments, when the second extendable hole punch is extended, it contacts the second extendable hole punch receiving portion of the second structural support. In at least one embodiment, the adjustable segment is coupled to the distal end of the first structural support.

In certain embodiments, the adjustable segment further comprises a pivot and lock mechanism which facilitates the adjustment of the impact surfaces.

In some embodiments, the first and second levers are biased such that the proximal ends remain open and wherein overcoming the open bias causes one of the plurality of impact surfaces to bear against the distal end of the second lever.

In at least one embodiment, at least one of the plurality of impact surfaces has an extended area.

In at least one embodiment, at least one of the plurality of impact surfaces is substantially flat.

In at least one embodiment, at least one of the plurality of impact surfaces is concave.

In certain embodiments, the embellishment setting device punches holes and sets a variety of different sized embellishments in an efficient and quiet manner.

In some embodiments, the embellishment setting device is used on a variety of different materials including, but not limited to, paper, fabric, plastic, chipboard, wood, acrylic, poly, leather, metal, purses, clothing, binding books and CDs.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
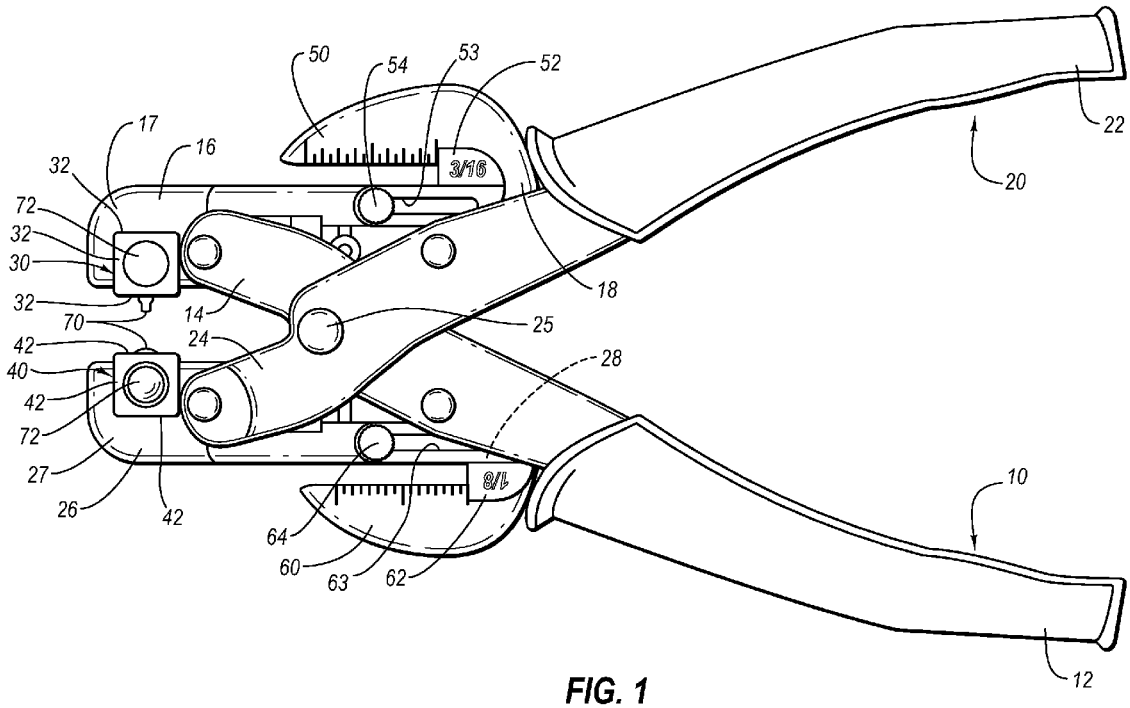
FIG. 1 is a side elevation view of an exemplary embellishment setting device according to at least one embodiment.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, one of ordinary skill in the art will understand that the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

FIG. 1 is a side view of an exemplary embellishment setting device according to at least one embodiment. As illustrated in this figure, in at least one embodiment an embellishment setting device may comprise a first lever 10 with a handle portion, a second lever 20 with a handle portion, and a first adjustable segment 30. Both first lever 10 and second lever 20 generally have proximal ends 12, 22 and distal ends 14, 24, respectively. First lever 10 is pivotally coupled to second lever 20 at pivot point 25. The first adjustable segment 30 may comprise any suitable type or form of structure capable of being placed and maintained in one or more positions such that when the proximal ends of the first and second levers 12, 22 are moved toward each other, at least one of a plurality of impact surfaces 32 bears against a portion of the distal end 24 of the second lever.

As seen in FIG. 1, the distal end of the second lever 20 may comprise a second adjustable segment 40 that also has a plurality of impact surfaces 42. As is also seen in FIG. 1, the distal end of the first lever 14 may further comprise a first jaw in the form of a first structural support member 16 that has a distal first jaw portion 17 and a proximal first jaw portion 18. Likewise, the distal end of the second lever 24 may also further comprise a second jaw in the form of a second structural support member 26 with a distal second jaw portion 27 and a proximal second jaw portion 28. In at least one embodiment, the first adjustable segment 30 is connected to the distal portion of the first jaw 16 and the second adjustable segment 40 is connected to the distal portion of the second jaw 26. The second adjustable segment 40 may comprise any suitable type or form of structure capable of being placed and maintained in one or more positions such that when the proximal ends of the first and second levers 12, 22 are moved toward each other, at least one of a plurality of impact surfaces 42 bears against a portion of the distal end 14 of the first lever.

As seen in FIG. 1, the embellishment setting device may further comprise first depth gauge 50 that is connected to the proximal first jaw portion 18. Similarly, a second depth gauge 60 may be connected to the proximal second jaw portion 28. The first and second depth gauges 50, 60 may be used to create a hole in a material at specific depth location as measured from a peripheral edge of the material. Movable depth gauge bases 52, 62 include respective slots 53, 63 (See FIG. 3C also) to allow the gauge bases to be moved in fore and aft positions and set appropriate depth positions for depth gauges 50, 60. Threaded locking screws 54, 64 may then be used to secure the bases 52, 62 in desired locations.

In some embodiments, such as in the embodiment shown in FIG. 1, the first and second levers 10, 20 are biased such that the proximal ends 12, 22 remain open in a static condition. Overcoming the bias (by urging handles 10, 20 toward each other) causes one of the plurality of impact surfaces 32 to approach and ultimately bear against one of the plurality of opposing impact surfaces 42.

FIG. 1 also shows a plurality of specialized extension or other embellishment surfaces or structures 70. Surfaces or structures 70 may extend, protrude, or extrude from the plurality of impact surfaces 32, 42 to facilitate the setting of a desired embellishment. For instance, where the embellishment is an eyelet (not shown), impact surface 32 may include an extension portion 70 suitable for setting an eyelet. The plurality of extension portions 70 may generally comprise any type or form of structure that could be helpful in setting all types of embellishments. Extensions portions 70 may be biased, rigid, flexible, impressionable, or of any other material or configuration suitable for creating or setting an embellishment. For example, an extension portion 70 may help stabilize and secure the eyelet so that it can be properly set. Because embellishments vary in types, sizes, and shapes, different types, sizes, and shapes of extension portions 70 may be used. Embellishments generally represent any type or form of structure that can be created in or set onto a material, including without limitation eyelets and snaps of any shape or size. For setting some embellishments, rather than an actual extension portion, depressions or indentations 72 may be used. Depressions or indentations may be generally concave or otherwise recessed relative to impact surfaces 32, 42, and may be any suitable type, size, or shape.

Figure 2:
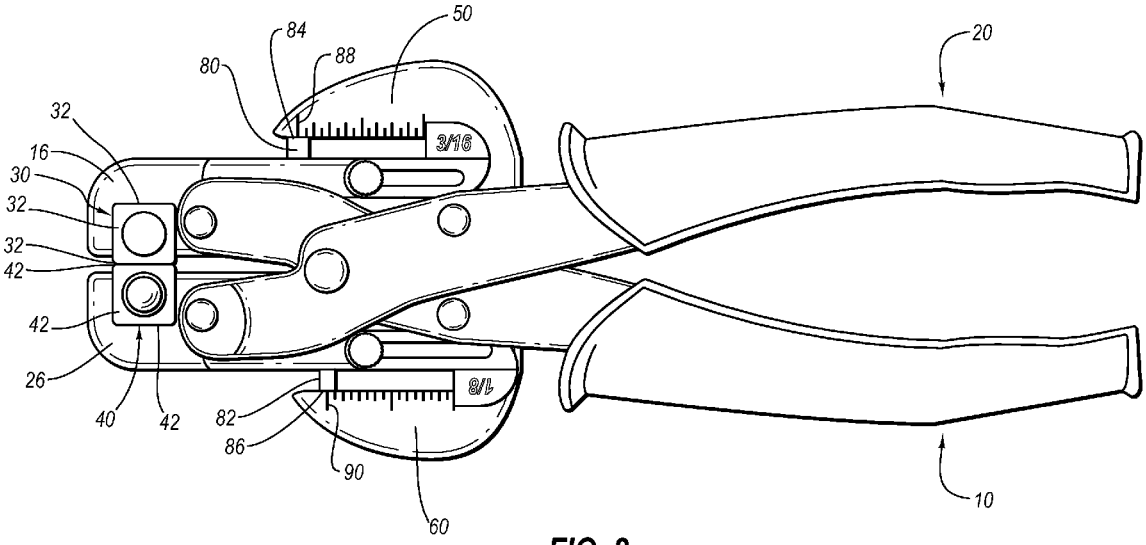
FIG. 2 is a side elevation view of an exemplary embellishment setting device according to at least one embodiment showing an extendable hole punch in an extended position.

FIG. 2 shows an exemplary embellishment setting device according to at least one embodiment. FIG. 2 shows a first extendable hole punch 80 associated with the first depth gauge 50. Movable hole punch 80 may be secured to the first structural support 16. First hole punch 80 is shown in FIG. 2 in an extended position. First extendable hole punch 80 may be received by a corresponding aperture 84 (FIG. 3C) in depth gauge 50. FIG. 2 also shows a second extendable hold punch 82 in an extended position. Second extendable hole punch 82 may be associated with the second depth gauge 60. Movable hole punch 82 may be secured to the second structural support 26. Second extendable hole punch 82 may be received by a corresponding aperture (not shown) in depth gauge 60.

Figure 3A:
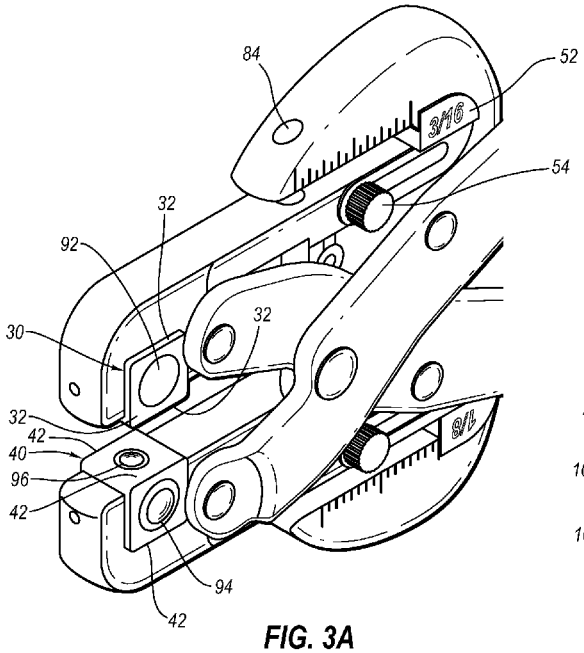
FIG. 3A is a partial perspective view of the exemplary embellishment setting device illustrated in FIG. 1.
Figure 3B:
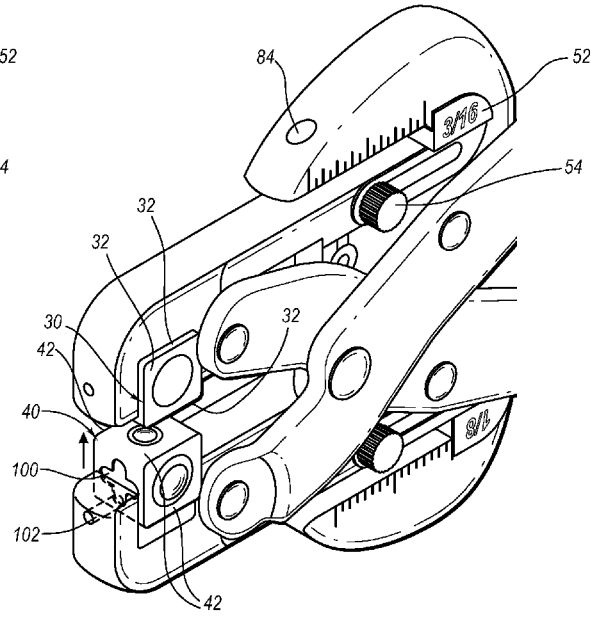
FIG. 3B is a partial perspective view of an exemplary embellishment setting device that shows a pivot and lock mechanism.
Figure 3C:
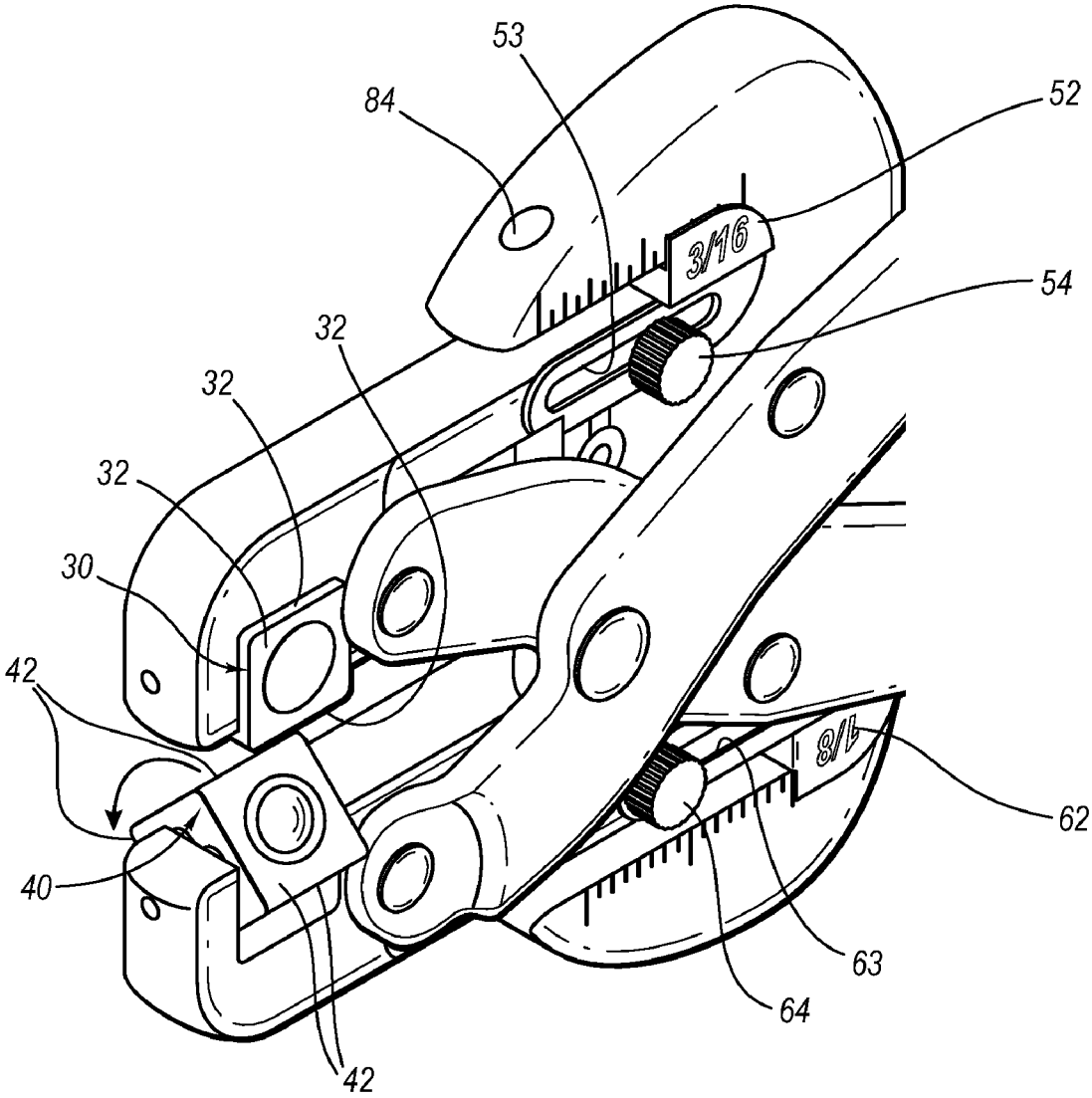
FIG. 3C is a partial perspective view of an exemplary embellishment setting device that shows the adjustable segment being moved between positions.

In at least one embodiment, the first and second extendable hole punch apertures or receiving portions (aperture 84 is shown in FIG. 3C) may each comprise a hollow shaft through which the material displaced by the first and second extendable hole punches 80, 82 may exit the device. In at least one embodiment, the first and second extendable hole punch receiving portions 84, 86 comprise an enclosed shaft (not shown).

In at least one embodiment, as is shown in FIG. 2, when the embellishment setting device is compressed, one of the plurality of first impact surfaces 32 and another of the plurality of second impact surfaces 42 bear against each other.

FIG. 3A shows the first adjustable segment 30 and second adjustable segment 40, each of which may include a plurality of impact surfaces 32, 42. The plurality of impact surfaces may be different from each other. For example, either the upper impact surface 32 or the lower impact surface 42 may comprise a concave portion 96 or another type of centered impact surface 96. As discussed above, the different shapes of impact surfaces 32, 42 may facilitate the effective setting of embellishments.

In at least one embodiment, and as illustrated in FIG. 3B, first and second adjustable segments 30, 40 may include a slotted pivot and lock mechanism with slots 100 corresponding to a particular impact surface. Slots 100 ride into and are secured in place around a pin 102, which together provide the pivot and lock mechanism. Other suitable types and forms of structures may be used to allow rotation of elements 30, 40 for presenting different impact surfaces 32, 42, respectively.

Figure 4:
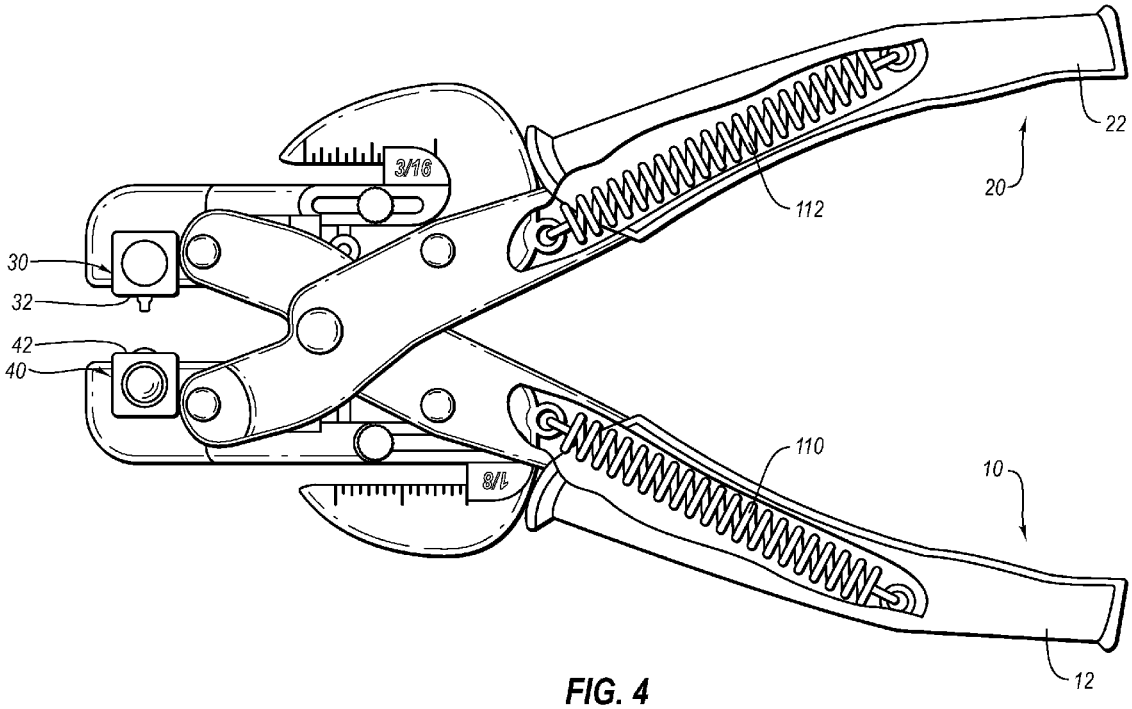
FIG. 4 is a side elevation view, partly in section, of the exemplary embellishment setting device illustrated in FIG. 1.
Figure 5:
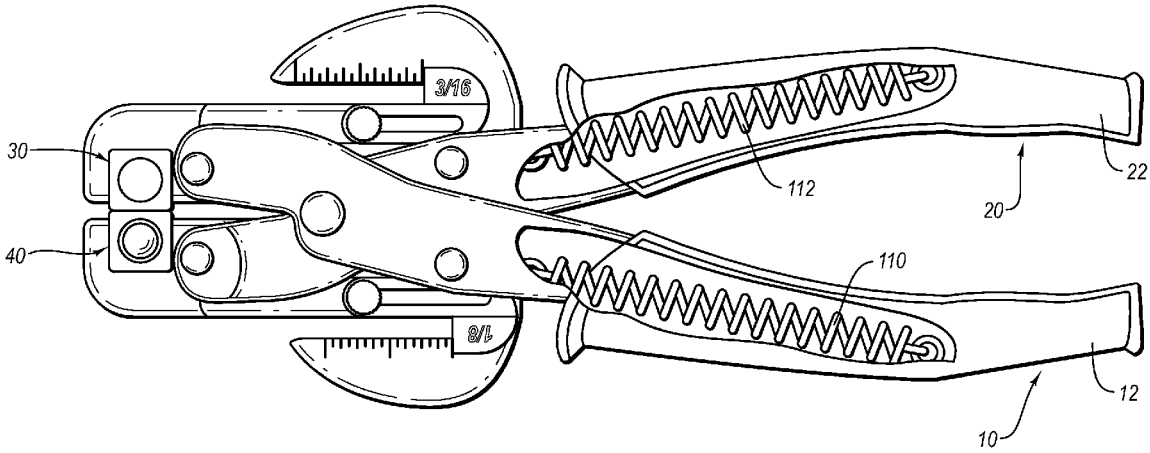
FIG. 5 is a side elevation view, partly in section, of the exemplary embellishment setting device illustrated in FIG. 1 that shows the device in a compressed position.

FIG. 4 shows that first and second levers 10, 20 may include springs 110, 112, which bias the proximal ends 12, 22 of the first and second levers 10, 20 in an open position. FIG. 5 shows a cross-sectional side view of the exemplary embellishment setting device in a compressed position, where the bias of springs 110, 112 has been overcome by urging handles 10, 20 toward each other.

The preceding description has been provided to enable others of ordinary skill in the art to best utilize various aspects of the exemplary embodiments described herein. This exemplary description is not intended to be exhaustive or to be limited to any precise form disclosed. Many modifications and variations are possible without departing from the spirit and scope of the instant disclosure. In particular, one or more of the exemplary embodiments described and/or illustrated herein may be used in combination with one another to achieve the desired result of setting embellishments. For example, in certain embodiments, the exemplary embellishment setting device illustrated in FIG. 1 may not include first and second depth gauges 50, 60 or first and second extendable hole punch receiving portions 84, 86. As will be appreciated, the various exemplary embodiments described and/or illustrated herein may be mixed and matched as needed to achieve the desired result of setting embellishments.

It is desired that the embodiments described herein be considered in all respects illustrative and not restrictive and that reference be made to the appended claims and their equivalents for determining the scope of the instant disclosure. Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising."

What is claimed is:

1. An apparatus for setting embellishments comprising:

a first lever;

a second lever pivotally coupled to the first lever, wherein the first and second levers each has a proximal end and a distal end and wherein the first lever further comprises a first structural support having a distal portion and a proximal portion; and an adjustable segment coupled to the distal end of the first lever, the adjustable segment having a plurality of impact surfaces wherein one of the plurality of impact surfaces is positioned opposite the distal end of the second lever such that compression of the proximal ends of the first and second levers causes the one of the plurality of impact surfaces to bear against the distal end of the second lever; and a first adjustable depth gauge having a first extendable hole punch receiving portion, wherein the first adjustable depth gauge is connected to the proximal portion of the first structural support.

2. The apparatus of claim 1, further comprising a second adjustable segment coupled to the distal end of the second lever, the second adjustable segment having a plurality of impact surfaces, wherein the compression of the proximal ends of the first and second levers causes one of the plurality of impact surfaces of the adjustable segment to bear against one of the plurality of impact surfaces of the second adjustable segment.

3. The apparatus of claim 1, wherein the first adjustable depth gauge is coupled to the first lever, and the apparatus further comprises:

a second adjustable depth gauge, wherein the second adjustable depth gauge is coupled to the second lever.

4. The apparatus of claim 1, wherein the adjustable segment further comprises a pivot and lock mechanism which facilitates the adjustment of the impact surfaces.

5. The apparatus of claim 1, wherein the first and second levers are biased such that the proximal ends remain open and wherein overcoming the open bias causes one of the plurality of impact surfaces to bear against the distal end of the second lever.

6. The apparatus of claim 1, wherein at least one of the plurality of impact surfaces has an extrusion.

7. The apparatus of claim 1, wherein at least one of the plurality of impact surfaces is substantially flat.

8. An apparatus for setting embellishments comprising:

a first lever;

a second lever pivotally coupled to the first lever, wherein the first and second levers each has a proximal end and a distal end;

an adjustable segment coupled to the distal end of the first lever, the adjustable segment having a plurality of impact surfaces wherein one of the plurality of impact surfaces is positioned opposite the distal end of the second lever such that compression of the proximal ends of the first and second levers causes the one of the plurality of impact surfaces to bear against the distal end of the second lever;

a first extendable hole punch connected to the first lever; and a second extendable hole punch connected to the second lever.

9. The apparatus of claim 8, wherein the distal end of the first lever further comprises a first structural support having a distal portion and a proximal portion, wherein the distal end of the second lever further comprises a second structural support having a distal portion and a proximal portion, and further comprising:

a first adjustable depth gauge having a first extendable hole punch receiving portion, wherein the first adjustable depth gauge is connected to the proximal portion of the first structural support;

a second adjustable depth gauge having a second extendable hole punch receiving portion, wherein the second adjustable depth gauge is connected to the proximal portion of the second structural support;

wherein the first extendable hole punch is connected to the first structural support, and the first extendable hole punch contacts the first extendable hole punch receiving portion of the first structural support when the first extendable hole punch is extended; and wherein the second extendable hole punch is connected to the second structural support, and the second extendable hole punch contacts the second extendable hole punch receiving portion of the second structural support when the second extendable hole punch is extended; and wherein the adjustable segment is coupled to the distal end of the first structural support.

10. The apparatus of claim 8, wherein the first and second extendable hole punches are operable independent of the adjustable segment.

11. An apparatus for setting embellishments comprising:

a first lever;

a second lever pivotally coupled to the first lever, wherein the first and second levers each has a proximal end and a distal end and wherein the first lever further comprises a first structural support having a distal portion and a proximal portion;

a first adjustable segment coupled to the distal end of the first lever, the first adjustable segment having a plurality of impact surfaces;

a second adjustable segment coupled to the distal end of the second lever, the second adjustable segment having a plurality of impact surfaces wherein one of the plurality of impact surfaces is positioned opposite the distal end of the first lever such that compression of the proximal ends of the first and second levers causes one of the plurality of impact surfaces of the first adjustable segment to bear against one of the plurality of impact surfaces of the second adjustable segment; and a first adjustable depth gauge having a first extendable hole punch receiving portion, wherein the first adjustable depth gauge is connected to the proximal portion of the first structural support.

12. The apparatus of claim 11, wherein the first adjustable depth gauge is coupled to the first lever, and the apparatus further comprises:

a second adjustable depth gauge, wherein the second adjustable depth gauge is coupled to the second lever.

13. The apparatus of claim 11, further comprising:

a first extendable hole punch connected to the first lever; and a second extendable hole punch connected to the second lever.

14. The apparatus of claim 11, wherein the distal end of the first lever further comprises a first structural support having a distal portion and a proximal portion, wherein the distal end of the second lever further comprises a second structural support having a distal portion and a proximal portion, and further comprising:

a first adjustable depth gauge having a first extendable hole punch receiving portion, wherein the first adjustable depth gauge is connected to the proximal portion of the first structural support;

a second adjustable depth gauge having a second extendable hole punch receiving portion, wherein the second adjustable depth gauge is connected to the proximal portion of the second structural support;

a first extendable hole punch connected to the first structural support, wherein the first extendable hole punch contacts the first extendable hole punch receiving portion of the first structural support when the first extendable hole punch is extended;

a second extendable hole punch connected to the second structural support, wherein the second extendable hole punch contacts the second extendable hole punch receiving portion of the second structural support when the second extendable hole punch is extended; and wherein the first adjustable segment is coupled to the distal end of the first structural support and the second adjustable segment is coupled to the distal end of the first structural support.

15. The apparatus of claim 11, wherein the first and second adjustable segments further comprise pivot and lock mechanisms which facilitate the adjustment of the impact surfaces.

16. The apparatus of claim 11, wherein the first and second levers are biased such that the proximal ends remain open and wherein overcoming the open bias causes one of the plurality of impact surfaces to bear against the distal end of the second lever.

17. The apparatus of claim 11, wherein at least one of the plurality of impact surfaces has an extrusion.

18. The apparatus of claim 11, wherein at least one of the plurality of impact surfaces is substantially flat.

19. An Apparatus for setting embellishments comprising:

a first lever;

a second lever pivotally coupled to the fast lever, wherein the first and second levers each has a proximal end and a distal end;

a first adjustable segment coupled to the distal end of the first lever, the first adjustable segment having a plurality of impact surfaces;

a second adjustable segment coupled to the distal end of the second lever, the second adjustable segment having a plurality of impact surfaces wherein one of the plurality of impact surfaces is positioned opposite the distal end of the first lever such that compression of the proximal ends of the first and second Levers causes one of the plurality of impact surfaces of the first adjustable segment to bear against one of the plurality of impact surfaces of the second adjustable segment;

a first adjustable depth gauge, wherein the first adjustable depth gauge is coupled to the first lever; and a second adjustable depth gauge, wherein the second adjustable depth gauge is coupled to the second lever.

20. The apparatus of claim 19, wherein the first and second adjustable segments further comprise pivot and lock mechanisms which facilitate the adjustment of the impact surfaces.

21. The apparatus of claim 19, wherein the first and second levers are biased such that the proximal ends remain open and wherein overcoming the open bias causes one of the plurality of impact surfaces to bear against the distal end of the second lever.

22. The apparatus of claim 19, wherein at least one of the plurality of impact surfaces has an extrusion.

23. The apparatus of claim 19, wherein at least one of the plurality of impact surfaces is substantially fiat.

24. An apparatus for setting embellishments comprising:

a first lever;

a second lever pivotally coupled to the first lever, wherein The first and second levers each has a proximal end and a distal end;

a first adjustable segment coupled to the distal end of the first lever, the first adjustable segment having a plurality of impact surfaces;

a second adjustable segment coupled to the distal end of the second lever, the second adjustable segment having a plurality of impact surfaces wherein one of the plurality of impact surfaces is positioned opposite the distal end of the first lever such that compression of the proximal ends of the first and second levers causes one of the plurality of impact surfaces of The first adjustable segment to bear against one of the plurality of impact surfaces of the second adjustable segment;

a first adjustable depth gauge, wherein the first adjustable depth gauge is coupled to the first lever;

a second adjustable depth gauge, wherein the second adjustable depth gauge is coupled to the second lever;

a first extendable hole punch connected to the first lever; and a second extendable hole punch connected to the second lever.

25. An apparatus for setting embellishments comprising:

a first lever;

a second lever pivotally coupled to the first lever, wherein the first and second levers each has a proximal end and a distal end, wherein the distal end of the first lever further comprises a first structural support having a distal portion and a proximal portion, wherein the distal end of the second lever further comprises a second structural support having a distal portion and a proximal portion;

a first adjustable segment coupled to the distal end of the first lever, the first adjustable segment having a plurality of impact surfaces;

a second adjustable segment coupled to the distal end of the second lever, the second adjustable segment having a plurality of impact surfaces wherein one of the plurality of impact surfaces is positioned opposite the distal end of the first lever such that compression of the proximal ends of the first and second levers causes one of the plurality of impact surfaces of the first adjustable segment to bear against one of the plurality of impact surfaces of the second adjustable segment;

a first adjustable depth gauge having a first extendable hole punch receiving portion, wherein the first adjustable depth gauge is connected to the proximal portion of the first structural support;

a second adjustable depth gauge having a second extendable hole punch receiving portion, wherein the second adjustable depth gauge is connected to the proximal portion of the second structural support;

a first extendable hole punch connected to the first structural support, wherein the first extendable hole punch contacts the first extendable hole punch receiving portion of the first structural support when the first extendable hole punch is extended;

a second extendable hole punch connected to the second structural support, wherein the second extendable hole punch contacts the second extendable hole punch receiving portion of the second structural support when the second extendable hole punch is extended; and wherein the first adjustable segment is coupled to the distal end of the first structural support and the second adjustable segment is coupled to the distal end of the first structural support.

* * * * *